United States Patent [19]

Sherwood

[11] 4,044,942

[45] Aug. 30, 1977

[54] MULTIPLE MAILING FOLDER

[75] Inventor: Jack Edward Sherwood, Roanoke, Va.

[73] Assignee: Double Envelope Corporation, Roanoke, Va.

[21] Appl. No.: 506,709

[22] Filed: Sept. 17, 1974

[51] Int. Cl.[2] ..... B65D 27/06

[52] U.S. Cl. ..... 229/73; 229/92.1; 229/92.7

[58] Field of Search ..... 229/73, 92.1, 92.3, 229/92.7

[56] References Cited

U.S. PATENT DOCUMENTS

| | | | |
|---|---|---|---|
| 225,319 | 3/1880 | Barton | 229/92.1 |
| 1,040,004 | 10/1912 | Patton | 229/92.1 X |
| 1,089,486 | 3/1914 | Levine | 229/73 |
| 1,995,183 | 3/1935 | Kovnat | 229/73 |
| 2,759,658 | 8/1956 | Sawdon | 229/73 |
| 3,111,336 | 11/1963 | Schumacher | 229/73 X |
| 3,131,854 | 5/1964 | Deutschmeister | 229/73 |

*Primary Examiner*—Stephen P. Garbe

*Attorney, Agent, or Firm*—Frederick W. Turnbull

[57] ABSTRACT

An advertising multiple use mailing folder or mailer including an envelope which may be twice used in furthering the completion of a business transaction.

8 Claims, 5 Drawing Figures

MULTIPLE MAILING FOLDER

Many lettersheets and mailing folders have been devised in which an envelope is formed with removable tab or flap portions. The removable portions may form address labels to be used at a later time, order blanks, or merely carry an explanatory text or advertising. The U.S. Pat. No. 1,089,486 to Levine is illustrative of the type of mailer which is the subject of the present invention. Although the broad concept of such mailers is old, the known mailing folders are too expensive to manufacture, difficult for the addressor to send out and difficult for the addressee to use. Banks, philatelists and other businesses require inexpensive, secure, easily used mailers.

It is a primary object of the present invention therefore to provide an inexpensive multiple use mailer.

It is a further object to provide a mailer that is easy for the addressee to understand and use.

It is still a further object to provide units that may be fed through automatic addressing machines, and which for a second and a third mailing will provide a secure envelope.

Other and further objects and advantages will appear from the following specification taken with the accompanying drawings in which like reference characters refer to similar elements in the several views and in which.

Figure 4:
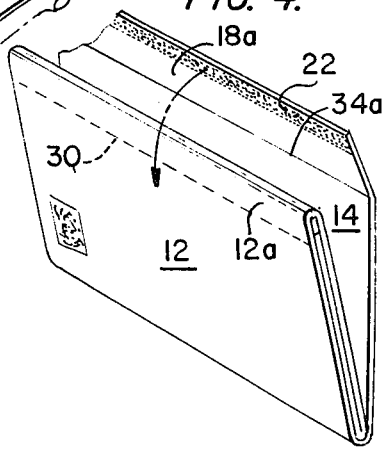

FIG. 4 indicates how the envelope is closed for its second mailing; and

Figure 5:
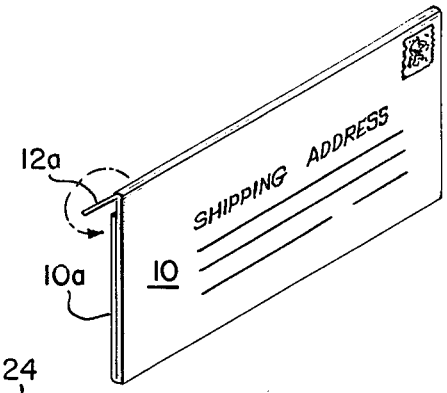

FIG. 5 shows the envelope prepared for its final mailing.

Figure 1:
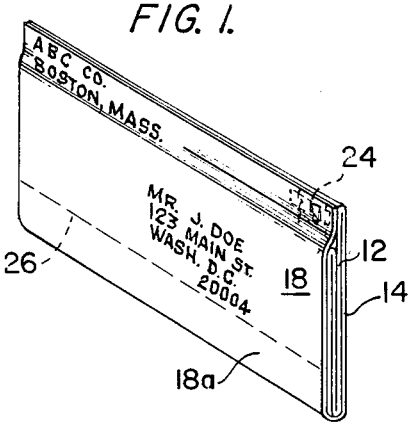
FIG. 1 is a perspective view of the device as it appears at the time of its first mailing.
Figure 2:
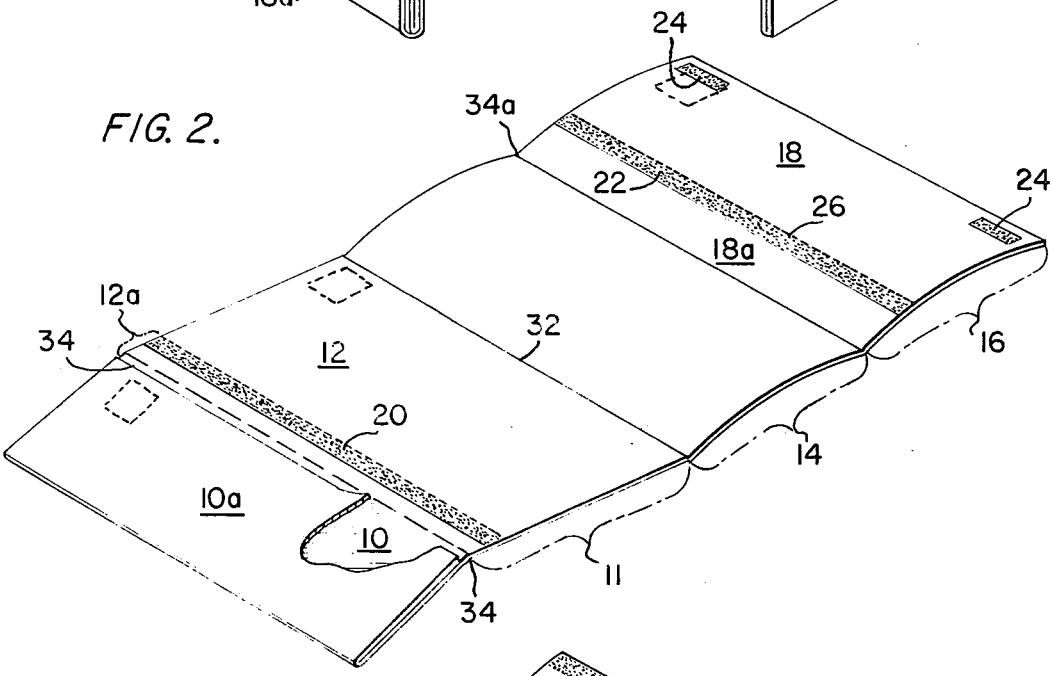
FIG. 2 is a perspective view of the device having been received and opened by the first addressee.
Figure 3:
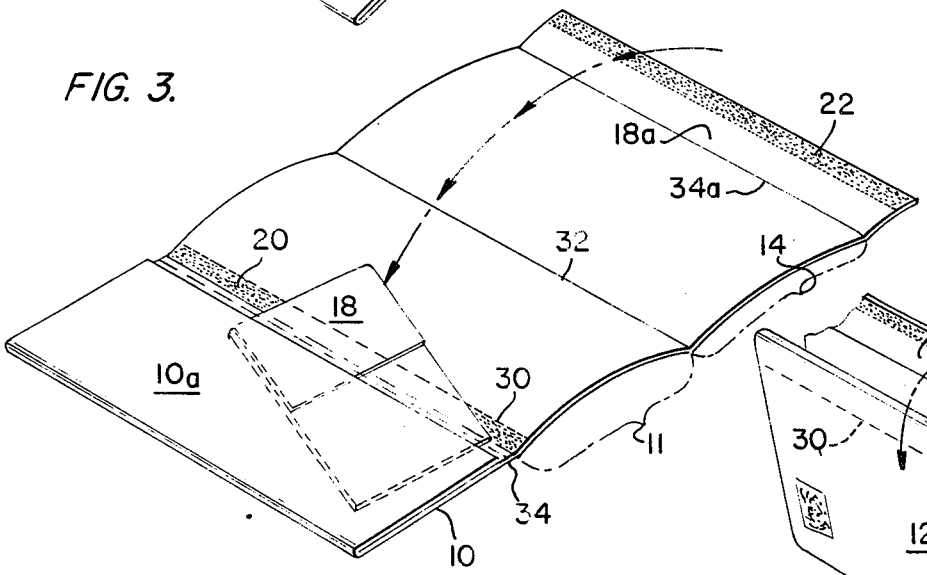
FIG. 3 is a view similar to the view of FIG. 2 as the first addressee is preparing the mailer for its second mailing to return the mailer to the original addressor with an order for the product or services.

In FIG. 2 the letter sheet or mailer of the present invention is seen in a way that illustrates the device as it appears when first opened by the first addressee after having been received in the condition shown in FIG. 1, but also in a way that illustrates the very simple and inexpensive method by which the mailer is made.

The mailer may be considered as being of five panels. **10, 10*a*, 11, 14 and 16. Panels 10 and 10*a* form an envelope pocket by folding the edge (panel 10*a***) of a continuous web of paper inwardly over transverse stripes of adhesive as the web of paper comes from a rotary printing press. This is done in the manner shown in a U.S. Pat. No. 1,325,311 to Armstrong.

At the same time that the adhesive is applied that closes the envelope ends, stripes and spots of adhesive, to be used art the time of one or other of the mailings are applied. Stripe 20 is applied on panel 11 and stripe 22 and spots 24 are applied on panel 16. The stripes are lengthwise of the web of paper coming from the rotary press.

A line of perforations 26 is provided parallel to and adjacent the stripe 22 to permit the order blank 18 to be severed from the panel 16 leaving a portion **18*a* carrying adhesive 22, and a line of perforations 30 is provided parallel to adhesive stripe 20 to permit the envelope and its closing flap 12*a* including adhesive 20, as seen in FIG. 5, to be severed from the panel 11 leaving portion 12*a*** to close the mailer for its final mailing.

It will be noted that portion **18*a* must be wider than portion 12*a* so that, in sealing the device for return to the merchant, adhesive 22 will adhere to portion 12, rather than portion 12*a*.**

It will be seen from FIG. 2 that, after the web has been printed, the envelope pockets have been formed along one edge of the web of paper, and the stripes and spots of adhesive have been added and the web has been perforated on lines 26 and 30, to form lines of weakness, the web of paper is then folded, first along a fold line 32 between panels 12 and 14 bringing the bottom edge of the envelope panel **10, 10*a* to a position adjacent, but not to cover adhesive spots 24 to provide a margin of panel 16 beyond the bottom fold of envelope 10, 10*a*. The web is then folded again to bring the fold 32 up to the outer edge of panel 16 so that adhesive spots 24 secure the panel 16 to panel 12** to complete the assembly of the multiple mailer strip. Machines to fold continuous webs of paper are known. The assembled mailers are then severed in succession and collected into bundles of separate mailers.

The reverse side of the order blank portion 18 preferably carries the address of the prospective customer. The reverse side of panel portion 12 preferbly carries the address of the merchant to which the prospective customer is to forward the mailer. This panel may also carry return postage to be paid by the merchant.

Both sides of panel 14 and the obverse side of panel 12 may be printed with advertising.

The reverse sie of the envelope panel 10 is provided with space calling for the prospective customer to fill in his name and address, and it preferably carries as a "return address" the name and address of the merchant.

It will be noticed, that, as received by the prospective customer, the envelope pocket is secured between panels 11 and 16. The envelope closing flap **12*a*, carrying adhesive 20, forming part of panel 11 is folded away from the opening of the envelope pocket. After the prospective customer has removed and filled out the order blank 18 which forms part of panel 16, he folds it and places it (with or without a check or money order) into the envelope pocket 10, 10*a*. The prospective customer reverses the fold 34 so that the envelope pocket overlies the panel 11. The customer should then fill in his name and address on the envelope panel 10. The device is then again folded along fold line 32 and the portion 18*a* of panel 16, remaining after having torn off the order blank 18, is folded along fold line 34*a* as seen in FIG. 4 and the adhesive 22** is activated to secure the device in closed condition.

Upon receipt of the mailer by the merchant the mailer is opened, the envelope portion **10*a* , 10, 12*a* is severed along the line of weakness 30, the order blank and the enclosed check or money order is removed from the envelope, the transaction ordered on the order blank is carried out, the information required is inserted in the envelope 10*a*, 10, 12*a* and the closure 12*a* is folded over to bring the adhesive 20 into contact with panel 10*a*** of the envelope to seal it for mailing.

The customer will then receive the envelope with its contents. The contents of the envelope will vary, or course, with the type of business with which it is used. If the material ordered is, for instance, machinery the contents of the envelope may be a bill of lading indicating that the machinery has been shipped, etc. If the mailer is used by a bank, the enclosure in the envelope when returned to the customer would be, say, a deposit slip. If the mailer is used by a philetelist the envelope contents would be the stamps ordered by the customer.

Having thus described the invention, I claim:

1. A multiple use mailing folder, formed from a blank consisting of an elongated strip of sheet material having transverse fold lines dividing said strip into five panels, the first panel at one end of said strip having been folded forwardly against the adjacent second panel and adhesively secured thereto at its ends to form an envelope pocket, the said envelope pocket having been folded rearwardly on the fold line between the second and third panels, said third panel being of greater width than said first and second panels having a portion of said third panel exposed beyond the said envelope pocket, said fourth panel having been folded forwardly along the fold line between said third and fourth panels to overlie said third panel on its side remote from said envelope pocket. Said fifth panel having been folded forwardly along the fold line between said fourth and fifth panels to overlie the fold line between said envelope pocket and said third panel and to overlie said envelope pocket and being of a width to overlie at least part of said portion of said third panel exposed beyond said envelope pocket.

2. The multiple use mailing folder of claim 1 in which said third panel is provided with a line of weakness whereby part of said third panel may be severed leaving a closure flap portion for said envelope pocket, and a line of adhesive on said closure flap portion.

3. The multiple use mailing folder of claim 2 in which said fifth panel is provided with a line of adhesive so positioned that when refolded with the envelope pocket positioned between said third and fourth of said panels, said line of adhesive may be adhered to said third panel adjacent the fold line between said second and third panels.

4. The multiple use mailing folder of claim 3 in which said fifth panel includes a line of weakness adjacent said line of adhesive remote from said fourth panel.

5. The multiple use mailing folder of claim 3 which includes adhesive means on the fifth panel overlying the portion of said third panel exposed beyond said envelope pocket, whereby said fifth panel may be adhered to said third panel to hold said mailing folder in folded position.

6. The multiple use mailing folder of claim 1 which includes adhesive means on the fifth panel overlying the portion of said third panel exposed beyond said envelope pocket whereby said fifth panel may be adhered to said third panel to hold said mailing folder in folded position.

7. The multiple use mailing folder of claim 4 which includes adhesive means on the fifth panel overlying the portion of said third panel exposed beyond said envelope pocket whereby said fifth panel may be adhered to said third panel to hold said mailing folder in folded position.

8. A multiple mailing folder comprising an envelope pocket having an opening, a first closure flap folded away from said envelope pocket opening carrying a stripe of adhesive to be used to seal the envelope when said closure flap is folded toward the envelope, an extension of said first closure flap joined thereto by a line of weakness and of a width such that, as folded away from said envelope with said closure flap it extends beyond said envelope pocket, a panel extending from said extension of said closure flap joined thereto by a fold line, said panel being folded along said fold line to overlie said first closure flap and its extension on the side of said closure flap carrying said stripe of adhesive, and remote from said envelope pocket, a second closure flap extending from said panel and joined thereto by a fold line said second closure flap carrying a stripe of adhesive, an extension to said second closure flap joined thereto by a line of weakness along said stripe of adhesive on said second closure flap remote from said fold line joining said second closure flap and said panel, said second closure flap and said extension to said second closure flap being folded over said envelope pocket opening and having a combined width such that, folded over said panel, said first closure flap and its extension, and over said envelope, the remote edge of said extension to said second closure flap will overlie the portion of the extension of said first closure flap beyond said envelope, and adhesive means on the extension of said second closure flap to secure it to said extension of said first closure flap.

* * * * *